United States Patent [19]

Griffin

[11] Patent Number: 4,587,818

[45] Date of Patent: May 13, 1986

[54] KEY RING HOLDER

[76] Inventor: Groves L. Griffin, 1370 McIntosh Rd., Douglasville, Ga. 30134

[21] Appl. No.: 472,950

[22] Filed: Mar. 7, 1983

[51] Int. Cl.[4] ..... A45F 5/02

[52] U.S. Cl. ..... 70/457; 24/3 K; 24/3 R; 24/336; 70/458; 70/459; 224/252; 224/255

[58] Field of Search ..... 70/457–459; 224/252, 255, 256; 24/3 K, 3 H, 3 J, 3 L, 3 R, 335, 336

[56] References Cited

U.S. PATENT DOCUMENTS

| | | | |
|---|---|---|---|
| 928,006 | 7/1909 | Thomas | 24/3 K |
| 1,408,589 | 3/1922 | Hachmann | 24/3 K |
| 1,539,220 | 5/1925 | Taylor | 224/255 X |
| 1,609,347 | 12/1926 | Dee | 24/3 K |
| 1,848,032 | 3/1932 | Tessier | 24/3 K |
| 3,357,615 | 11/1966 | Hill | 24/3 K X |
| 3,519,177 | 7/1968 | Voinovich | 24/3 K |

*Primary Examiner*—Robert L. Wolfe
*Assistant Examiner*—Lloyd A. Gall
*Attorney, Agent, or Firm*—B. J. Powell

[57] ABSTRACT

A holder for mounting a key ring on a relatively thin support member such as a belt comprising a generally U-shaped base clip member with legs resiliently urged toward each other to removably grip the thin support member therebetween and a ring clip member on one of the legs with a reverse curved tip portion directed back toward the projecting end of the leg with the tip portion resiliently urged toward the leg to define a ring receiving recess between the ring clip member and the leg so that the key ring can be inserted into said ring receiving space by forcing the key ring between the tip portion and the leg, but can only be removed from the ring receiving space by manually forcing the tip portion away from the leg to permit the ring to pass therebetween.

3 Claims, 10 Drawing Figures

KEY RING HOLDER

BACKGROUND OF THE INVENTION

This invention relates to key ring holders for conveniently supporting keys on a key ring on a belt or the like.

Persons frequently mount their keys on a key ring and then carry the key ring on a belt mounted holder. While some of these prior key holders have had simple one-piece constructions and were easy to use, it was typically easy to inadvertently dislodge the key ring from the holder or to have someone take the key ring without the wearer's knowledge. Attempts have also been made to provide a more secure holder; however, such holders have typically been difficult to operate and complicated in construction. As a result, there still exists a need for a simple key ring holder which is easy to operate by the wearer and which is secure.

SUMMARY OF THE INVENTION

These and other problems and disadvantages associated with the prior art are overcome by the invention disclosed herein by providing a key ring holder which is both simple in construction and secure in operation. Further, the holder is extremely simple to operate by the user permitting the user to install and remove the key ring on the holder using only one hand. The holder with the key ring mounted thereon may be removed from the wearer's belt, yet it is virtually impossible to slip the holder from the person's belt without the wearer's knowledge. Further, any inadvertent distortion in the holder during use can be easily restored by the user.

The holder of the invention includes a base clip member adapted to removably grip the wearer's belt or the like and a ring clip member attached to the base clip member to hold a key ring in the ring receiving space between the ring clip member and the base clip member. The ring clip member has a curved tip that curves toward the base clip member and back toward that end of the ring clip member attached to the base clip member to prevent the key ring from being removed without manually forcing the curved tip away from the base clip member. A slot under the curved tip on the ring clip member permits the curved tip to extend into the slot to insure that the key ring will not inadvertently pass between the tip and the base clip member.

These and other features and advantages of the invention disclosed herein will become more apparent upon consideration of the following specification and accompanying drawings wherein like characters of reference designate corresponding parts throughout the several views and in which:

These figures and the following detailed description disclose specific embodiments of the invention; however, it is to be understood that the inventive concept is not limited thereto since it can be incorporated in other forms.

DETAILED DESCRIPTION OF ILLUSTRATIVE EMBODIMENTS

Figure 7:
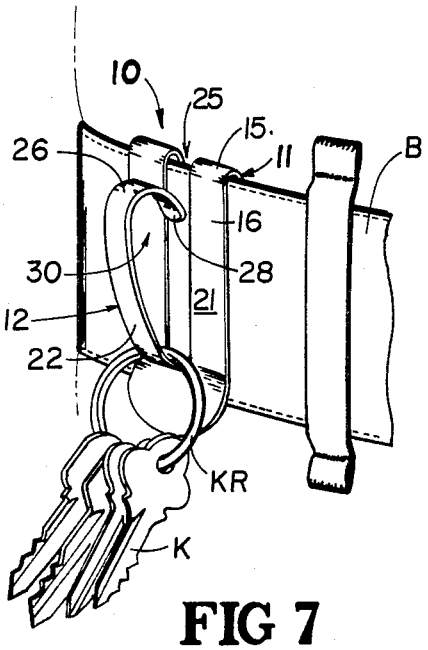
FIGS. 7–10 illustrate the invention in use.

Referring to the drawings, it will be seen that the invention is incorporated in a key ring holder 10 including a base clip member 11 and a ring clip member 12. The base clip member 11 serves to removably mount the holder 10 on a relatively thin support member such as a belt B as illustrated in FIG. 7 while the ring clip member 12 serves to removably mount a key ring KR on the holder 10.

The base clip member 11 is generally U-shaped with a curved central section 15 and a pair of legs 16 and 18 integral with opposite ends of the central section 15 and projecting out from the central section in an overlying manner. The legs 16 and 18 thus define a belt receiving space 19 therebetween closed at one end by the curved section 15. The rear leg 18 is generally straight while the front leg 16 has a guide tip 20 on the projecting end thereof bent outwardly away from the rear leg 18 to facilitate the insertion of the support member into the belt receiving space. The legs 16 and 18 are resilient so that the projecting ends thereof are resiliently urged toward each other to removably grip the thin support member such as belt B.

The ring clip member 12 is mounted on the front leg 16 and projects outwardly therefrom over the external face 21 of leg 16 so that the member 12 lies on that side of leg 16 opposite leg 18. The near end of the ring clip member 12 is integral with leg 16 through a bend 24 oriented normal to the longitudinal axis $A_1$ of the leg 16 and lying in the plane of the face 21. The bend 24 is located a distance $d_1$ from the central section 15 of the base clip member 11. As will become more apparent, the ring clip member 12 is sheared from the base clip member 11 so that a slot 25 extends from the bend 24 longitudinally along leg 16 through the curved central section 15 and into the rear leg 18. The slot 25 terminates a prescribed distance $d_2$ down the rear leg 18 from the central section 15. Since the axis of bend 24 is normal to the axis of slot 25, it will be appreciated that the ring clip member 12 is in registration with the slot 25. The width of the ring clip member 12 decreases from its near end integral with leg 16 to its projecting end.

The ring clip member 12 has a first section 22 that curves outwardly away from the external face 21 of front leg 16 and also upwardly toward the central section 15 of base clip member 11. The clip member 12 then, through reverse curve section 26, curves back toward the face 21 of leg 16 and downwardly away from the central section 15 so that the projecting tip 28 on the ring clip member 12 projects into the slot 25 past the external face on leg 16. Because the slot 25 is formed when the ring clip member 12 is sheared from the base clip member 11, the width of the slot 25 decreases along its length with that portion of slot 25 in the back leg 18 corresponding in width to the tip 28. When the ring clip member 12 is bent into its final shape, it will be seen that the tip 28 lies in a portion of the slot 25 which is wider than the tip 28. This insures that the tip 28 will pass into the slot 25 in clearance to prevent binding. Thus, it will be seen that a ring receiving space 30 is defined between the ring clip member 12 and the front leg 16. The resiliency of the ring clip member 12 allows the tip 28 to be deflected away from leg 16 so that the key ring KR can be inserted into or removed from space 30 by passing between tip 28 and the external face 21 of leg 16.

Figure 8:
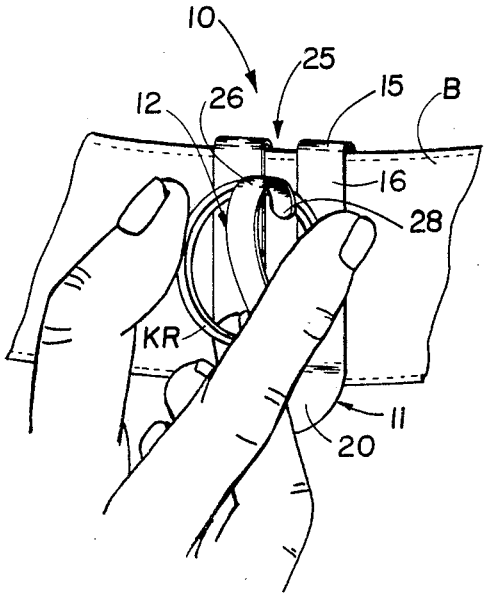

As best seen in FIG. 8, the key ring KR is inserted into the space 30 by pushing the key ring down between the tip 28 and leg 16. Since the tip angles toward the leg, the ring deflects the tip 28 away from the leg 16 so that it can move past the tip 28 and into space 30. Since the tip 28 angles away from the leg 16 when seen from within the space 30, the key ring KR cannot be removed from the space 30 simply by pulling up on the key ring KR inasmuch as the tip 28 deflects the ring away from, rather than toward, the leg 16. In order to remove the key ring KR from space 30, the user places his thumb down on that side of the tip 28 opposite space 30 and presses the tip away from leg 16 until the ring KR will pass up between the tip 28 and leg 16 and out of space 30.

Figure 5:
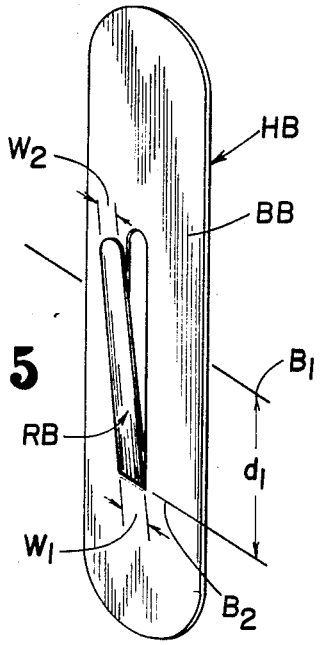
FIG. 5 is a perspective view illustrating the blank from which the holder is made.
Figure 1:
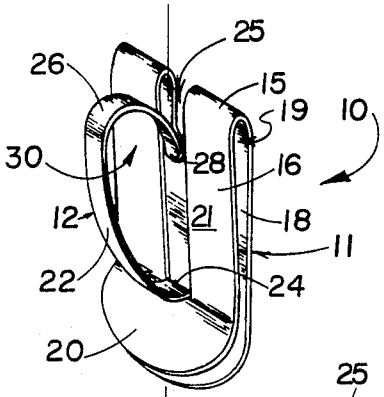
FIG. 1 is a perspective view illustrating the invention.
Figure 3:
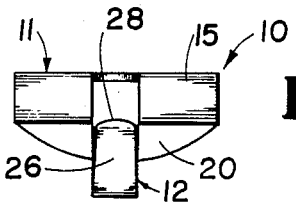
FIG. 3 is a top plan view thereof.
Figure 4:
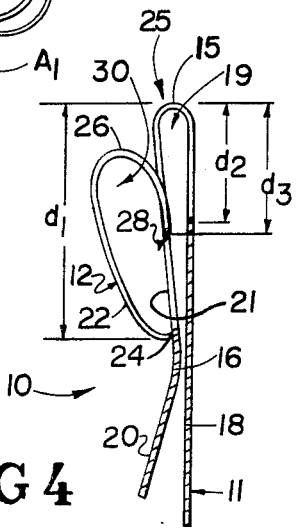
FIG. 4 is a longitudinal cross-section thereof taken along line 4—4 in FIG. 2.
Figure 2:
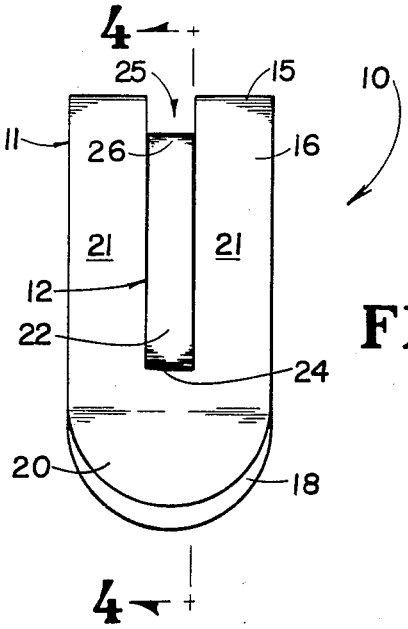
FIG. 2 is a front elevational view thereof.

It will also be appreciated that the tip 28 projects a distance $d_3$ from the central section 15 toward the projecting ends of legs 16 and 18 so that tip 28 projects through the slot 25 in the leg 16 but lies below the slot 25 on the rear leg 18. As will become more apparent, this limits the distance that tip 28 can be forced through the slot in front leg 16 so that the tip 28 will not interfere with the mounting of holder 10 on belt B. Further, this insures that no portion of the ring clip member 12 will be forced into slot 25 at the same position from which it was removed so as to prevent binding. If the elastic limit of the ring clip member 12 is exceeded during use so that the tip 28 does not project down into slot 25, then the member 12 can be bent back to its original condition by pressing the member 12 toward the leg 16 until the tip 28 strikes the rear leg 18. The natural resiliency of the clip member 12 causes the tip 28 to return to the position shown in FIG. 4 after the clip member 12 has been released.

The holder 10 is seen in use in FIGS. 7–10. FIG. 7 illustrates the holder 10 mounted on a belt B carrying a key ring KR with keys K thereon. The base clip member 11 is inserted over the belt so that the central section 15 engages the top of the belt to limit the downward movement of the holder 10.

The key ring KR is installed in the holder 10 as illustrated in FIG. 8. While the user grasps the key ring KR in his hand, he forces the key ring KR down between the ring clip member 12 and the base clip member 11 so that the ring engages the tip 28. Since the tip 28 angles toward the leg 16 in the direction that the key ring KR is to be moved, the key ring KR deflects the tip 28 away from the leg 16 and out of the slot 25 so that the key ring KR can pass between the tip 28 and the leg 16 into the ring receiving space 30. The natural resiliency of the ring clip member 12 urges the tip 28 back into the slot 25 so that the key ring KR is now installed in the space 30 within the clip member 12 as illustrated in FIG. 8. If the user tries to remove the key ring KR simply by lifting up on the ring KR, he will not be able to do so since the tip 28 angles away from the leg 16 in the same direction that the key ring KR would be moving which will force the tip 28 further into the slot 25 rather than out of the slot 25. Thus, once the key ring KR is installed in the ring receiving space 30 under the ring clip member 12, it cannot be inadvertently removed.

Figure 9:
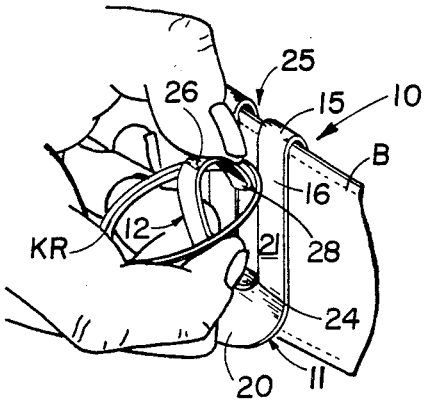

If the user does desire to remove the key ring KR from the holder 10, the user grasps the key ring KR in his fingers as illustrated in FIG. 9 while placing his thumb on top of the ring clip member 12 so that his thumb pushes the tip 28 away from the leg 16 against the resiliency of the clip member 12. When the user has pushed the tip 28 far enough away from the front leg 16 to allow the key ring KR to clear, the user then pushes up on the key ring KR with his fingers until it passes the projecting end of the tip 28 and is free to move over the clip member 12 and be released from the holder 10. While this action is easy for the user to perform, the motions required to remove the key ring KR from the holder 10 are such that it would be virtually impossible for someone to remove the key ring KR from the holder 10 without the user's knowledge.

Figure 10:
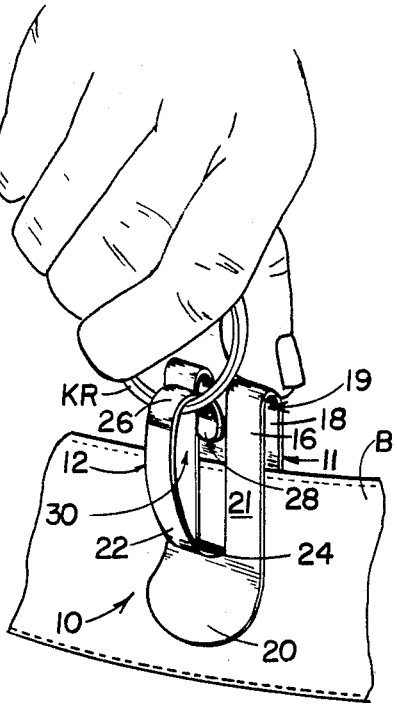

It is sometimes desirable to remove the holder 10 with the key ring KR still attached thereto. This procedure is illustrated in FIG. 10. It will be appreciated that, when the key ring KR is lifted up under the clip member 12, the key ring KR engages the ring clip member 12 in the reverse curve section 26 so that the key ring KR is spaced out from the front leg 16. Thus, the force applied to the holder 10 by the key ring KR as it is pulled up causes the base clip member 11 to twist on the belt B about an axis generally normal to the longitudinal axis of the clip member 11. This naturally tends to make the base clip member 11 harder to pull off the belt B. To compensate for this, the user places his thumb behind the rear leg 18 of the base clip member 11 while he pulls up on the key ring KR by grasping the keys and key ring in his fingers and thus is able to keep the base clip member 11 from twisting. This allows the user to easily slip the holder 10 up off his belt B. If someone else tries to remove the holder 10 by pulling up on the key ring KR, the twisting of the base clip member 11 will warn the user that the holder 10 is being removed. If the person trying to remove the holder 10 places his thumb behind the base clip member 11, then the user would likewise be cognizant that someone is trying to remove the holder 10.

The holder 10 is fabricated from a flat strip of material from which a holder blank HB is cut. The holder blank HB has a length equal to the sum of the lengths of the legs 16 and 18 as well as the central section 15 of the base clip member 11. The holder blank HB then has the ring clip blank RB partly punched out of the strip to leave the base clip blank BB. As will become more apparent, the base blank BB is bent along the transverse bend line $B_1$ to form the base clip member 11 while the ring clip blank RB is formed into the ring clip member 12. Thus, that portion of the ring clip blank RB left unsevered from the base clip blank BB is located the distance $d_1$ from the bend line $B_1$ so that the ring clip blank RB is bent outwardly away from the base clip blank BB along the bend line $B_2$ to form the bend 24 therein. It will also be appreciated that the ring clip blank RB tapers from a width $W_1$ at that end left integral with the base clip blank BB to a narrower width $W_2$ at the projecting end thereon. When the ring clip blank RB is bent into the ring clip member 12, it will be appreciated that the tip 28 lies in the slot 25 closer to the bend 24 and that portion of the slot 25 from which the tip 28 was sheared. This tapering of the ring clip member 12 insures a good clearance between the tip 28 and the edges of the slot 25 to keep the tip 28 from binding in the slot 25 during use. The guide tip 20 may be formed in the base clip bank BB before or after the base clip blank BB has been folded along the bend line $B_1$.

Figure 6:
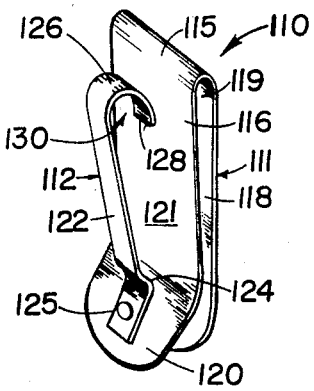
FIG. 6 is a perspective view illustrating a second embodiment of the invention.

A second embodiment of the key ring holder is illustrated in FIG. 6 and has been designated 110. The key ring holder 110 has a base clip member 111 to which a separate ring clip member 112 is attached. The base clip member 111 corresponds to the base clip member 11 except that there is no slot therein. The base clip member 111 thus has a curved central section 115 with a front leg 116 and a rear leg 118 integral with and projecting out from the central section 115 in an overlapping manner to define a belt receiving space 119 therebetween. The front leg 116 is provided with an outwardly bent guide tip 120.

The ring clip member 112 is mounted on the guide tip 120 of front leg 116 with a rivet 125 and is bent outwardly away from the tip 120 through bend 124 so that the ring clip member 112 has a section 122 curving outwardly away from the external face 121 of the front leg 16 and also upwardly toward the central section 115 in the base clip member 111, a reverse curve section 126 which curves back toward the face 121 of leg 116 and then downwardly away from the central section 115 so that the projecting tip 128 on the ring clip member 112 lies against the external face 121 on the front leg 116. The ring receiving space 130 is thus defined between the ring clip member 112 and the front leg 116. The key ring KR is installed in the ring receiving space 130 and removed therefrom similar to that of the first embodiment of the holder 10. The projecting end of the tip 128 on the ring clip member 112 is cut normal to the axis of the ring clip member 112 rather than being rounded as illustrated in the first embodiment of the invention to reduce the likelihood of the key ring KR inadvertently passing between the tip 128 and the external face 121 of the leg 116 when the key ring KR is within the space 130.

What is claimed as the invention is:

1. A holder for mounting a key ring on a relatively thin support member such as a belt comprising:

a generally U-shaped base clip member including a curved central section and a pair of resilient legs integral with opposite ends of said central section and projecting away from said central section in an overlapping relationship so that the projecting ends of said legs are resiliently urged toward each other to removably grip the thin support member therebetween; and a ring clip member integral with one of said legs, said ring clip member including a first section attached to said one leg intermediate its ends and extending away from said one leg opposite said other leg and toward said central section; and a second curved section integral with the projecting end of said first section, said second section curving back toward said leg and including a tip portion directed back toward the projecting end of said one leg, said tip portion resiliently urged toward said one leg to define a ring receiving recess between said ring clip member and said one leg so that the key ring can be inserted into said ring receiving space by forcing the key ring between said tip portion and said one leg, but can only be removed from said ring receiving space by manually forcing said tip portion away from said one leg to permit the ring to pass therebetween, said ring clip member having been cut from said base clip member to form a slot extending along said one leg through said central section and into the other of said legs so that said slot is in registration with said tip portion on said ring clip member and said tip portion can move past said one leg to insure that the key ring will not inadvertently pass out of said ring receiving space without manually forcing said tip portion away from said one leg.

2. The holder of claim 1 wherein said tip portion on said ring clip member is out of registration with that portion of said slot in the other of said legs to prevent said tip portion from moving past said other of said legs.

3. The holder of claim 1 wherein said holder is made out of a material having limited resilience and a non-elastic yield strength such that said ring clip member can be bent at its juncture with said one leg to restore said tip portion back into said slot in the event said ring clip member is inadvertently bent out of shape.

* * * * *